US006686329B1

(12) United States Patent
Salager

(10) Patent No.: US 6,686,329 B1
(45) Date of Patent: Feb. 3, 2004

(54) MULTILAYER DETERGENT TABLET WITH DIFFERENT HARDNESS

(75) Inventor: Serge Eric Salager, Woluwe St. Etienne (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/762,748

(22) PCT Filed: Aug. 11, 1999

(86) PCT No.: PCT/US99/18273

§ 371 (c)(1),
(2), (4) Date: Feb. 12, 2001

(87) PCT Pub. No.: WO00/09646

PCT Pub. Date: Feb. 24, 2000

(30) Foreign Application Priority Data

Aug. 13, 1998 (EP) ..... 98202711

(51) Int. Cl.[7] ..... C11D 17/00

(52) U.S. Cl. ..... 510/446; 510/294; 510/298; 510/495

(58) Field of Search ..... 510/446, 224, 510/294, 298, 495

(56) References Cited

U.S. PATENT DOCUMENTS 4,294,717 A * 10/1981 Couderc et al. ..... 510/311
4,460,490 A * 7/1984 Barford et al. ..... 510/192
4,704,221 A * 11/1987 Bleil et al. ..... 510/442
4,913,832 A * 4/1990 Kruse et al. ..... 510/224
5,958,855 A * 9/1999 Binstock et al. ..... 510/224
5,972,870 A * 10/1999 Anderson ..... 510/298
6,274,538 B1 * 8/2001 Addison ..... 510/224
6,303,561 B1 * 10/2001 Painter ..... 510/446
6,358,911 B1 * 3/2002 Metzger-Groom

FOREIGN PATENT DOCUMENTS

DE 2207633 * 8/1973
DE 4404279 A1 * 8/1995
EP 0224128 A2 * 6/1987
EP 0466485 A2 * 1/1992
EP 0481547 A1 * 4/1992
EP 0524075 A1 * 1/1993
EP 0711827 A2 * 5/1996
EP 0851025 A2 * 7/1998
GB 911204 A * 7/1961
GB 1307387 A * 2/1973
WO WO 97/03177 A1 * 1/1997

* cited by examiner

*Primary Examiner*—Lorna M. Douyon
(74) *Attorney, Agent, or Firm*—Marianne Dressman; Jason J. Camp; Mark A. Charles

(57) ABSTRACT

The present invention relates to a detergent tablet having at least a first and a second layer, whereby the first layer is softer than the second layer, and if said tablet has more than two layers, the tablet is such that a softer layer is situated at an end of the tablet to increase the integrity and robustness of the entire tablet during production, shipping and handling while keeping substantially good dispensing properties.

20 Claims, 2 Drawing Sheets

MULTILAYER DETERGENT TABLET WITH DIFFERENT HARDNESS

The present invention relates to detergent tablets, especially those adapted for use in washing.

Although cleaning compositions in tablet form have often been proposed, these have not (with the exception of soap bars for personal washing) gained any substantial success, despite the several advantages of products in a unit dispensing form. One of the reasons for this may be that detergent tablets usually dissolve slower than the constituent powders from which they are made, simply because the constituent powders are forced close together in the tablet, with comparatively little opportunity for water to permeate between them. This gives rise to the problem that slow dissolving tablets cause residues which may for example be visible through the door of the washing machine during the wash cycle, or which stick to the fabrics at the end of the wash cycle, or both. This may be compensated by using low compression forces to keep high porosity and good dissolution profile. However, such tablets are typically softer and have mechanical characteristics such that breakage is likely to occur during production or handling.

DE-A-2 207 633, published on the $30^{th}$ of August 1973, discloses tablets having three layers, the middle layer being sandwiched between two end layers, the two end layers being made so as to protect the middle layers from mechanical shocks, while allowing tablet dissolution in less than a minute.

However, particularly in certain front loading washing machines, problems of tablet residues appearing visibly at the window of the washing machine have still been encountered. Indeed, in particular for detergent tablets, the dissolution problems are particularly acute, due for example to the tendency of gelling of the surfactant materials, or to low level of water used for environmental reasons, or due to dissolution at low temperature, etc.

The object of the present invention is to provide detergent tablets typically formed by compressing a particulate material, the tablet being suitable for storing, shipping and handling without breakage while dissolving easily and rapidly in wash solution, releasing the active ingredients into the wash solution and completely disintegrating and dispersing in alkaline or surfactant-rich solutions such as the wash liquor.

SUMMARY OF THE INVENTION

The object of the invention is achieved by providing a detergent tablet having at least a first and a second layer, whereby the first layer is softer than the second layer, and if said tablet has more than two layers, the tablet is such that a softer layer is situated at an end of the tablet.

DETAILED DESCRIPTION OF THE INVENTION

Figure 1:
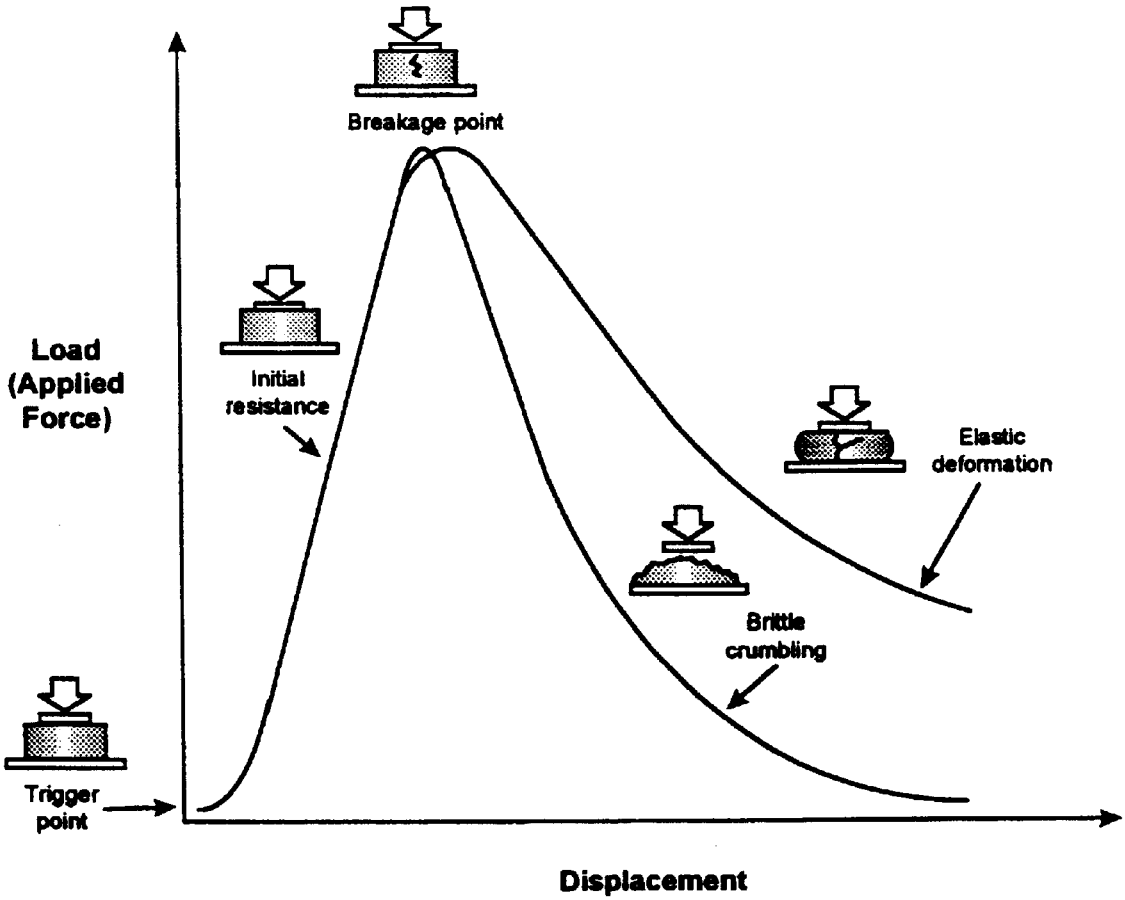
FIG. 1 represents two typical profiles for measuring the elasticity of a layer or of a tablet.

FIG. 1 represents two typical profiles for measuring the elasticity of a layer or of a tablet, the profile representing the load applied to the tablet or layer, corresponding to the resistance of the tablet or layer, in function of the displacement of the load along the main axis of the tablet or layer.

A curve corresponding to a more elastic and to a less elastic tablet or layer are shown, together with schematics showing the structural changes to which the tablet or layer is submitted during the measurement.

Figure 2:
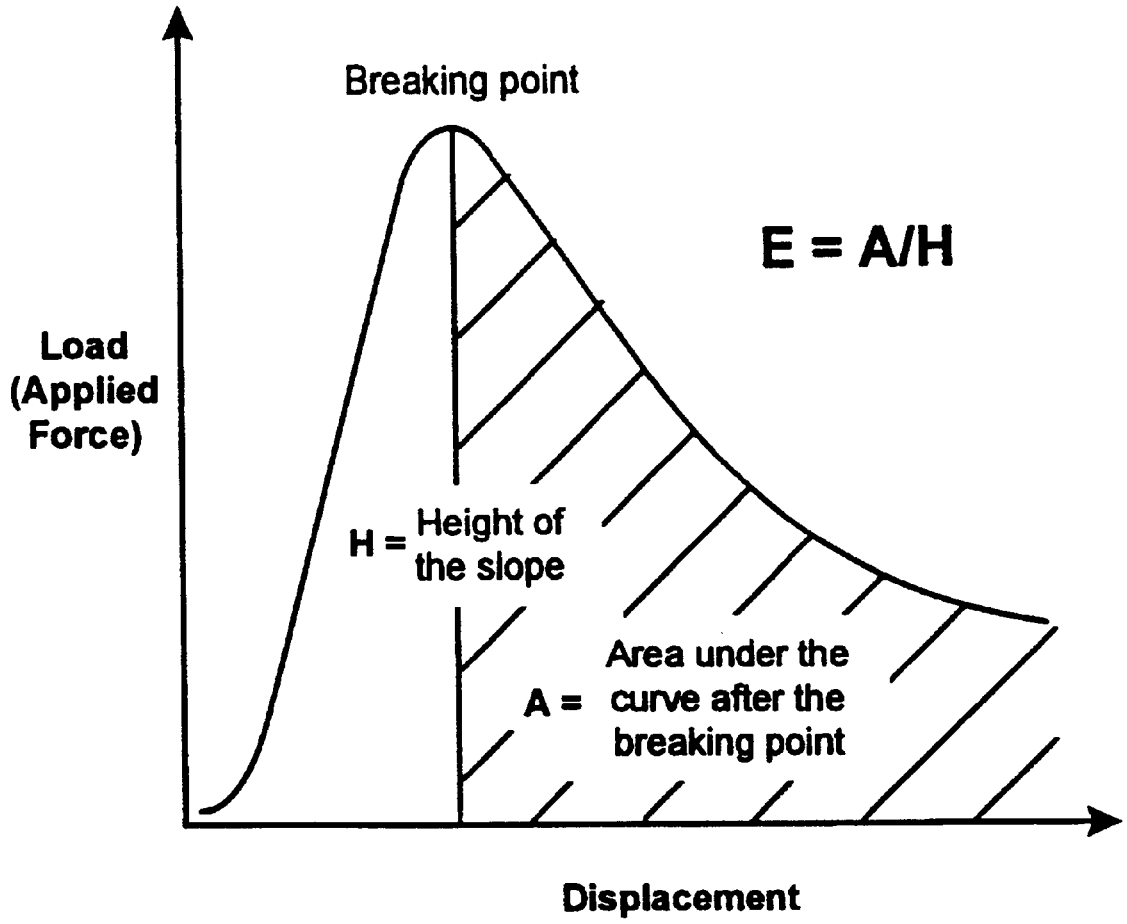
FIG. 2 represents a typical profile for measuring the elasticity of a layer or of a tablet.

FIG. 2 represents a typical profile for measuring the elasticity of a layer or of a tablet, the profile representing the load applied to the tablet or layer, corresponding to the resistance of the tablet or layer, in function of the displacement of the load along the main axis of the tablet or layer. The breaking point giving the maximum height H of the curve is marked, as well as the area A under the curved taken from the breaking point, whereby the elasticity is deduced from this by dividing A by H.

The invention relates to a detergent tablet. By detergent, it is meant that the tablet comprises surfactants. A tablet is defined as having a height along a main axis and a cross section normal to the main axis, the cross section being preferably substantially constant when travelling along the main axis, the tablet having two ends, each end being situated at each end of the main axis and having a surface area substantially equal to the cross section of the tablet.

The tablet is such that it comprises at least a first and a second layer. Normally, these layers are produced by compression of particulate materials. Composition of these layers may be similar or different, and compression force used for forming these layers may also be similar or different. It should be noted that a preferred embodiment of a tablet according to the invention comprises only two layers, but tablets with more layers may be considered.

According to the invention, a layer is preferably a part of a tablet made from compressing particulate materials, this part of the tablet having a height along the main axis of the tablet and a cross section corresponding to the cross section of the tablet, such that the composition or the physical and mechanical characteristics of this part differs from the rest of the tablet. In other words, a tablet according to the invention is made by piling up layers along the main axis to form the tablet, this layers adhering to each other to form the tablet, adhesion between layers being provided by mechanical or chemical means. Taken independently, each layer may be considered as a mono-layer tablet, as far as composition is concerned, for example.

According to the invention, the first layer is softer than the second layer. By softer, it should be understood that the tensile strength is lower than the tensile strength of the second layer. When more than two layers are present in the tablet, a softer layer is simply a layer such that there is another layer in the tablet which is less soft. In other words, if three layers are present with gradual and different softness, there are two softer layers. According to the invention, the softest layer is the layer most soft among all layers in the tablet. Same applies for harder, i.e. less soft, or hardest, i.e. least soft. Typically, the softer layer has a tensile strength 10% lower than the tensile strength of a harder layer part of the same tablet, preferably 20% lower, more preferably 30% lower, even more preferably 40% lower and most preferably 50% lower. According to the invention, the softness-hardness scale is measured by the tensile strength of the tablet.

According to the invention, if said tablet has more than two layers, the tablet is such that a softer layer is situated at an end of the tablet. The softer layer is not necessarily the softest layer. In a preferred embodiment, the softest layer is situated at one end. This is beneficial to dissolution because the surface activity of this soft layer is high because it is exposed as it is situated at one end. Indeed, according to the invention, the mechanical properties and the dissolution properties of a single tablet can be rendered more independent the ones from the others, so that a harder layer will more specifically provide mechanical integrity and protection while a softer layer will more specifically favour fast and efficient dissolution.

The level of softness of different layers may be set using different parameters, such as different chemical composition, or different compression force. In particular, if using different compositions, a layer may comprise more binders than another one to be made harder, i.e. less soft. It should be noted that it is preferred that a softer layer comprises higher levels of surfactant per weight. Indeed, a softer layer will more readily dissolve, and therefore will compensate gelling of surfactants by its softness. Indeed, gelling of surfactant is hindering fast and effective dissolution, which can be compensated by concentrating such surfactants in a softer layer. This can be advantageously combined with use of highly soluble compounds, hydrotrope compounds, and compounds providing high cohesive effect at lower compression force, for example.

In another preferred embodiment and in a two layer tablet according to the invention, the tablet is such that the less soft layer is situated at an end of the tablet. Indeed, it was found sufficient to obtain good mechanical characteristics to have one harder layer at one end of the tablet. This particularly applies to the method for making a tablet according to the invention, whereby the less soft layer of the tablet is placed at the bottom end of the tablet during production. Even more preferably, the least soft layer is placed at the bottom end of the tablet during production. Indeed, mechanical stress is particularly high during production, and almost only the bottom end of the tablet is exposed to mechanical constraints at this stage. Furthermore, this allows to obtain good mechanical resistance while allowing to place a softer layer at the other end of the tablet, whereby this softer layer will benefit of a higher surface of contact with solution when dissolving the tablet in solution.

Such mechanical resistance was found to be improved when using a tablet having a substantially rectangular cross section. Indeed, solidity of the tablet could be improved at constant compression value by using a rectangular tablet. At equal weight, equal compression force, equal composition, equal height and equal volume, rectangular tablet have a mechanical resistance significantly improved when compared to round tablets. This particularly applies to square tablets.

A layer may preferably have a height varying between 5 and 95% of the total tablet height. More preferably, the harder the layer is, the thinner it is to have a minimum impact on the overall dissolution of the entire tablet.

Typically, a two layer tablet according to the invention will comprise a soft layer having a tensile strength between 5 and 100 kPa, whereas the hard layer is having a tensile strength comprised between 5.5 and 150 kPa.

Elasticity

In a preferred embodiment according to the invention, the tablet comprises at least two layers having a different elasticity, the more elastic layer being more resistant to mechanical shocks, the more brittle layer having better dissolution characteristics. Indeed, a less elastic layer, thereby more brittle, will disperse readily in solution. In a most preferred embodiment, according to the invention, a softer layer is also a more brittle layer, and a harder layer is also more elastic. However, this may not be the case.

The elasticity of a tablet or of a layer from a tablet is evaluated as follows:

1—A load is pressed flat onto one end of the tablet or layer for which the elasticity is tested, the load being pressed along the direction of the main axis of the tablet or layer.

2—The force by the load is measured in function of the displacement of the load.

3—Two possible curves obtained by this method are illustrated in FIG. 1.

These two curves are showing the type of curves obtained for two different tablets or layers, one of the tablet being more elastic than the other, which in turn is more brittle (=less elastic). The elasticity value corresponding to the tablet or layer tested is deduced from this experimental curve as follows:

The area under the curve and beyond the breaking point is calculated by integrating the curve from its top value up to large displacement values. This area A is then divided by the height H of the curve at the breaking point for normalising the elasticity of the tablet or layer, E. This is illustrated in FIG. 2.

High values for E represent high elasticity, while low value represent highly brittle layers or tablets.

In order to achieve this test, the following equipment was used:

Instron 4444 series machine tester with a standard load cell of 2 kN linked to a normal PC computer. The program used to make the calculations was a Series IX version 7.49.00 provided by the equipment supplier.

A Plexiglas cylinder of 25 mm diameter, 30 mm height and a weight of 18 gr. was used to crush the tablet or layer.

A standard dye to make tablets or layers, this dye having a of 54 mm diameter.

the tablet or layer is placed between the plates of the Instron 4444 and the Plexiglas cylinder is placed in the middle of the tablet or layer end.

The cross head of the load cell moves at a constant speed of 10 mm/min and the computer starts to record the force of resistance of the tablet versus the displacement of the cylinder into the tablets.

The elasticity is calculated by dividing the area under the slope after the breakage point by its maximum height (see figures and explanations above).

The elasticity is hereby measured in J/kN (Joules for the area and kN for the maximum height used to normalise the area curves).

Typically, the elasticity value for a preferred embodiment of tablets according to the invention and more particularly adapted for laundry use is comprised between 0.5 and 5 J/kN, and more preferably between 1 and 4 J/kN. It is preferred that a more elastic layer or tablet for laundry use, for example, has an elasticity comprised between 3 and 4J/kN, more preferably between 3.1 and 3.5 J/kN. It is preferred that a more brittle layer or tablet for laundry use, for example, has an elasticity comprised between 1.5 and 2.5 J/kN, more preferably between 1.7 and 2.1 J/kN.

Highly Soluble Compounds

In a preferred embodiment, the tablet preferably comprises a highly soluble compound. More preferably, this compound is comprised or is present at higher levels per weight in the relatively hard layer of the tablet, i.e. the less soft layer, in order to further favour dissolution. Indeed, it may be preferred to aid dissolution of the harder layer, as this layer will for example be more compressed than a softer layer. Such a compound could be formed from a mixture or from a single compound. A highly soluble compound is defined as follow:

A solution is prepared as follows comprising de-ionised water as well as 20 grams per liter of a specific compound:

1—20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker. The mixer is set at a rotation speed of 200 turns per minute.

2—980 g of the de-ionised water is introduced into the Sotax beaker.

3—10 s after the water introduction, the conductivity of the solution is measured, using a conductivity meter.

4—Step 3 is repeated after 20, 30, 40, 50, 1min, 2 min, 5 min and 10 min after step 2.

5—The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 80° Celsius for ease of handling, but other forms may be used such as a paste or a liquid.

Example of highly soluble compounds include Sodium di isoalkylbenzene sulphonate or Sodium toluene sulphonate.

Cohesive Effect

In a preferred embodiment of this invention, the tablet preferably comprises a compound having a Cohesive Effect on the particulate material of a detergent matrix forming the tablet. More preferably, this compound is comprised or is present at higher levels per weight in the relatively hard layer of the tablet, i.e. the less soft layer, in order to obtain satisfactory hardness without need for high compression. The Cohesive Effect on the particulate material of a detergent matrix forming the tablet or a layer of the tablet is characterised by the force required to break a tablet or layer based on the examined detergent matrix pressed under controlled compression conditions. For a given compression force, a high tablet or layer strength indicates that the granules stuck highly together when they were compressed, so that a strong cohesive effect is taking place. Means to assess tablet or layer strength (also refer to diametrical fracture stress) are given in Pharmaceutical dosage forms: tablets volume 1 Ed. H. A. Lieberman et al, published in 1989.

The cohesive effect is measured by comparing the tablet or layer strength of the original base powder without compound having a cohesive effect with the tablet or layer strength of a powder mix which comprises 97 parts of the original base powder and 3 parts of the compound having a cohesive effect. The compound having a cohesive effect is preferably added to the matrix in a form in which it is substantially free of water (water content below 10% (pref. below 5%)). The temperature of the addition is between 10 and 80 C, more pref. between 10 and 40 C.

A compound is defined as having a cohesive effect on the particulate material according to the invention when at a given compacting force of 3000 N, tablets with a weight of 50 g of detergent particulate material and a diameter of 55 mm have their tablet tensile strength increased by over 30% (preferably 60 and more preferably 100%) by means of the presence of 3% of the compound having a cohesive effect in the base particulate material.

An example of a compond having a cohesive effect is Sodium di isoalkylbenzene sulphonate.

When integrating a highly soluble compound having also a cohesive effect on the particulate material used for a tablet or layer formed by compressing a particulate material comprising a surfactant, the dissolution of the tablet or layer in an aqueous solution is significantly increased. In a preferred embodiment, at least 1% per weight of a tablet or layer is formed from the highly soluble compound, more preferably at least 2%, even more preferably at lest 3% and most preferably at least 5% per weight of the tablet or layer being formed from the highly soluble compound having a cohesive effect on the particulate material.

It should be noted that a composition comprising a highly soluble compound as well as a surfactant is disclosed in EP-A0 524 075, this composition being a liquid composition.

A highly soluble compound having a cohesive effect on the particulate material allows to obtain a tablet having a higher tensile strength at constant compacting force or an equal tensile strength at lower compacting force when compared to traditional tablets. Typically, a whole tablet will have a tensile strength of more than 5 kPa, preferably of more than 10 kPa, more preferably, in particular for use in laundry applications, of more than 15 kPa, even more preferably of more than 30 kPa and most preferably of more than 50 kPa, in particular for use in dish washing or auto dish washing applications; and a tensile strength of less than 300 kPa, preferably of less than 200 kPa, more preferably of less than 100 kPa, even more preferably of less than 80 kPa and most preferably of less than 60 kPa. Indeed, in case of laundry application, the tablets should be less compressed than in case of auto dish washing applications for example, whereby the dissolution is more readily achieved, so that in a laundry application, the tensile strength is preferably of less than 30 kPa.

This allows to produce tablets or layers which have a solidity and mechanical resistance comparable to the solidity or mechanical resistance of traditional tablets while having a less compact tablet or layer thus dissolving more readily.

Furthermore, as the compound is highly soluble, the dissolution of the tablet or layer is further facilitated, resulting in a synergy leading to facilitated dissolution for a tablet according to the invention.

Tablet Manufacture

For the purpose of manufacture of a single layer, the layer may be considered as a tablet itself.

Detergent tablets of the present invention can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients. In particular for laundry tablets, the ingredients such as builder and surfactant can be spray-dried in a conventional manner and then compacted at a suitable pressure. Preferably, the tablets according to the invention are compressed using a force of less than 100000 N, more preferably of less than 50000 N, even more preferably of less than 5000 N and most preferably of less than 3000 N. Indeed, the most preferred embodiment is a tablet suitable for laundry compressed using a force of less than 2500 N, but tablets for auto dish washing may also be considered for example, whereby such auto dish washing tablets are usually more compressed than laundry tablets.

The particulate material used for making the tablet of this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 20 mm and 60 mm, preferably of at least 35 and up to 55 mm, and a weight between 25 and 100 g. The ratio of height to diameter (or width) of the tablets is preferably greater than 1:3, more preferably greater than 1:2. The compaction pressure used for preparing these tablets need not exceed 100000 $kN/m^2$, preferably not exceed 30000 $kN/m^2$, more preferably not exceed 5000 $kN/m^2$, even more preferably not exceed 3000 $kN/m^2$ and most preferably not exceed 1000 $kN/m^2$. In a preferred embodiment according to the invention, the tablet has a density of at least 0.9 g/cc, more preferably of at least 1.0 g/cc, and preferably of less than 2.0 g/cc, more preferably of less than 1.5 g/cc, even more preferably of less than 1.25 g/cc and most preferably of less than 1.1 g/cc.

Multi layered tablets are typically formed in rotating presses by placing the matrices of each layer, one after the other in matrix force feeding flasks. As the process continues, the matrix layers are then pressed together in the pre-compression and compression stages stations to form the multilayer layer tablet. With some rotating presses it is also possible to compress the first feed layer before compressing the whole tablet.

Hydrotrope Compound

In a preferred embodiment of the invention, a highly soluble compound having a cohesive effect is integrated to the tablet of the invention, whereby this compound is also a hydrotrope compound. Such hydrotrope compound may be generally used to favour surfactant dissolution by avoiding gelling, so that they may be for example advantageously comprised in a softer layer. A specific compound is defined as being hydrotrope as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.
2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.
3. The specific compound is hydrotrope if the the Octanoic Acid is completely solubilised, i.e. if the solution comprises only one phase, the phase being a liquid phase.

It should be noted that in a preferred embodiment of the invention, the hydrotrope compound is a flowable material made of solid particles at operating conditions between 15 and 60° Celsius.

Hydrotrope compounds include the compounds listed thereafter:

A list of commercial hydrotropes could be found in McCutcheon's Emulsifiers and Detergents published by the McCutcheon division of Manufacturing Confectioners Company. Compounds of interest also include:

1. Nonionic hydrotrope with the following structure:

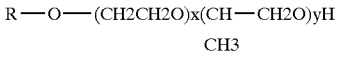

where R is a C8–C10 alkyl chain, x ranges from 1 to 15, y from 3 to 10.

2. Anionic hydrotropes such as alkali metal aryl sulfonates. This includes alkali metal salts of benzoic acid, salicylic acid, bezenesulfonic acid and its many derivatives, naphthoic acid and various hydroaromatic acids. Examples of these are sodium, potassium and ammonium benzene sulfonate salts derived from toluene sulfonic acid, xylene sulfonic acid, cumene sulfonic acid, tetralin sulfonic acid, naphtalene sulfonic acid, methyl-naphtalene sulfonic acid, dimethyl naphtalene sulfonic acid, trimethyl naphtalene sulfonic acid=Other examples include salts of dialkyl benzene sulfonic acid such as salts of di-isopropyl benzene sulfonic acid, ethyl methyl benzene sulfonic acid, alkyl benzene sulfonic acid with an alkyl chain length with 3 to 10, (pref. 4 to 9), linear or branched alkyl sulfonates with an alkyl chain with 1 to 18 carbons.
3. Solvent hydrotropes such as alkoxylated glycerines and alkoxylated glycerides, esters slakoxylated glycerines, alkoxylated fatty acids, esters of glycerin, polyglycerol esters. Preferred alkoxylated glycerines have the following structure:

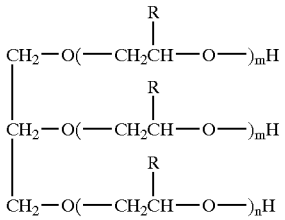

where l, m and n are each a number from 0 to about 20, with l+m+n=from about 2 to about 60, preferably from about 10 to about 45 and R represents H, $CH_3$ or $C_2H_5$ Preferred alkoxylated glycerides have the following struture

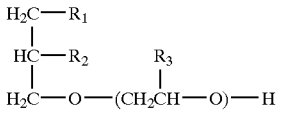

where R1 and R2 are each $C_nCOO$ or —(CH2CHR$_3$—O)$_l$—H where $R_3$=H, $CH_3$ or $C_2H_5$ and l is a number from 1 to about 60, n is a number from about 6 to about 24.

4. Polymeric hydrotropes such as those described in EP636687:

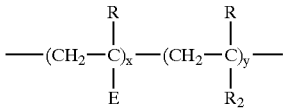

where E is a hydrophilic functional group,

R is H or a C1–C10 alkyl group or is a hydrophilic functional group;

R1 is H a lower alkyl group or an aromatic group,

R2 is H or a cyclic alkyl or aromatic group.

The polymer typically has a molecular weight of between about 1000 and 1000000.

5. Hydrotrope of unusual structure such as 5-carboxy-4-hexyl-2-cyclohexene-1-yl octanoic acid (Diacid®)

Use of such compound in the invention would further increase the dissolution rate of the tablet, as a hydrotrope compound facilitates dissolution of surfactants, for example. Such a compound could be formed from a mixture or from a single compound.

Coating

Solidity of the tablet according to the invention may be further improved by making a coated tablet, the coating covering a non-coated tablet according to the invention, thereby further improving the mechanical characteristics of the tablet while maintaining or further improving dissolution.

This very advantageously applies to multi-layer tablets according to the invention, whereby the mechanical characteristics of a harder layer can be transmitted via the coating to the rest of the tablet, thus combining the advantage of the coating with the advantage of the harder layer. Indeed, mechanical constraints will be transmitted through the coating, thus improving mechanical integrity of the tablet.

In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore it is advantageous if the coating material is dissolved under alkaline conditions, or is readily emulsified by surfactants. This contributes to avoiding the problem of visible residue in the window of a front-loading washing machine during the wash cycle, and also avoids deposition of undissolved particles or lumps of coating material on the laundry load.

Water solubility is measured following the test protocol of ASTM E1148-87 entitled, "Standard Test Method for Measurements of Aqueous Solubility".

Suitable coating materials are dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof.

The coating material has a melting point preferably of from 40° C. to 200° C.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 200° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid.

A coating of any desired thickness can be applied according to the present invention. For most purposes, the coating forms from 1% to 10%, preferably from 1.5% to 5%, of the tablet weight.

The tablet coatings of the present invention are very hard and provide extra strength to the tablet.

In a preferred embodiment of the present invention the fracture of the coating in the wash is improved by adding a disintegrant in the coating. This disintegrant will swell once in contact with water and break the coating in small pieces. This will improve the dissolution of the coating in the wash solution. The disintegrant is suspended in the coating melt at a level of up to 30%, preferably between 5% and 20%, most preferably between 5 and 10% by weight. Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins and mixtures thereof.

Tensile Strength

For the purpose of measuring tensile strength of a layer, the layer may be considered as a tablet itself.

Depending on the composition of the starting material, and the shape of the tablets, the used compacting force may be adjusted to not affect the tensile strength, and the disintegration time in the washing machine. This process may be used to prepare homogenous or layered tablets of any size or shape.

For a cylindrical tablet, the tensile strength corresponds to the diametrical fracture stress (DFS) which is a way to express the strength of a tablet or layer, and is determined by the following equation:

$$\text{Tensile strength}=2\ F/\pi Dt$$

Where F is the maximum force (Newton) to cause tensile failure (fracture) measured by a VK 200 tablet hardness tester supplied by Van Kell industries, Inc. D is the diameter of the tablet or layer, and t the thickness of the tablet or layer. For a non round tablet, πD may simply be replaced by the perimeter of the tablet.

(Method Pharmaceutical Dosage Forms: Tablets Volume 2 Page 213 to 217). A tablet having a diametral fracture stress of less than 20 kPa is considered to be fragile and is likely to result in some broken tablets being delivered to the consumer. A diametral fracture stress of at least 25 kPa is preferred.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Tablet Dispensing

The rate of dispensing of a detergent tablet can be determined in the following way:

Two tablets, nominally 50 grams each, are weighed, and then placed in the dispenser of a Baucknecht® WA9850 washing machine. The water supply to the washing machine is set to a temperature of 20° C. and a hardness of 21 grains per gallon, the dispenser water inlet flow-rate being set to 8 l/min. The level of tablet residues left in the dispenser is checked by switching the washing on and the wash cycle set to wash program 4 (white/colors, short cycle). The dispensing percentage residue is determined as follows:

$$\%\ \text{dispensing}=\text{residue weight}\times 100/\text{original tablet weight}$$

The level of residues is determined by repeating the procedure 10 times and an average residue level is calculated based on the ten individual measurements. In this stressed test a residue of 40% of the starting tablet weight is considered to be acceptable. A residue of less than 30% is preferred, and less than 25% is more preferred.

It should be noted that the measure of water hardness is given in the traditional "grain per gallon" unit, whereby 0.001 mole per liter=7.0 grain per gallon, representing the concentration of $Ca^{2+}$ ions in solution.

Effervescent

In another preferred embodiment of the present invention the tablets further comprises an effervescent.

Effervescency as defined herein means the evolution of bubbles of gas from a liquid, as the result of a chemical reaction between a soluble acid source and an alkali metal carbonate, to produce carbon dioxide gas, $$\text{i.e. } C_6H_8O_7+3NaHCO_3 \rightarrow Na_3C_6H_5O_7+3CO_2\uparrow+3H_2O$$

Further examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dissolution aid could be provided by using compounds such as sodium acetate or urea. A list of suitable dissolution aid may also be found in Pharmaceutical Dosage Forms: Tablets, Volume 1, Second edition, Edited by H. A. Lieberman et all, ISBN 0-8247-8044-2.

Detersive Surfactants

Surfactant are comprised in the tablet according to the invention. The dissolution of surfactants is favoured by the addition of the highly soluble compound.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3\text{-}M^+)\ CH_3$ and $CH_3\ (CH_2)_y(CHOSO_3\text{-}M^+)\ CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts. In a preferred embodiment, the tablet comprises at least 5% per weight of surfactant, more preferably at least 15% per weight, even more preferably at least 25% per weight, and most preferably between 35% and 45% per weight of surfactant.

Non Gelling Binders

Non gelling binders can be integrated to the particles forming the tablet in order to further facilitate dissolution.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: Acacia, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quatemary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

Non-gelling binder materials are preferably used in an amount within the range from 0.1 to 15% of the composition, more preferably below 5% and especially if it is a non laundry active material below 2% by weight of the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred. Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, now U.S. Pat. No. 4,634,551 European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

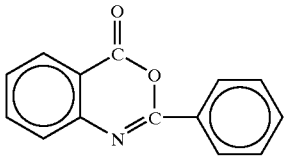

Still another class of preferred bleach activators includes the acyl lactam activators, especially acyl caprolactams and acyl valerolactams of the formulae:

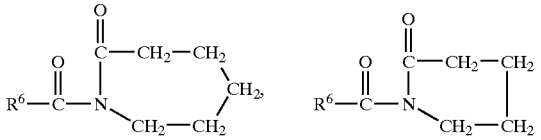

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate. Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAC)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243 and 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries AIS (Denmark) and MAXATASE by International Bio-Synthetics, Inc. (The Netherlands). Other proteases include Protease A (see European Patent Application 130,756, published Jan. 9, 1985) and Protease B European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Pat. No. 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Other components which are commonly used in detergent compositions and which may be incorporated into the detergent tablets of the present invention include chelating agents, soil release agents, soil antiredeposition agents, dispersing agents, brighteners, suds suppressors, fabric softeners, dye transfer inhibition agents and perfumes.

Method of Washing

It is known to place traditional laundry detergent tablets in the washing drum together with the laundry. However, this method tends to result in unsightly residues appearing visibly at the window, especially in certain types of washing machine which have been designed to operate with a lower water consumption. In extreme cases visible residues can also be left on clothes at the end of the wash cycle due to non complete dissolution.

The tablet according to the invention may be used according to a method of washing which significantly avoids this problem. The new method comprises preparing an aqueous solution of a laundry detergent for use in a washing machine, wherein the aqueous solution of laundry detergent is formed by dissolving in water a tablet according to the invention.

A preferred method more specifically relates to the preparation of an aqueous solution of a laundry detergent for use in a front-loading washing machine, the front-loading washing machine having a dispensing drawer and a washing drum, wherein the aqueous solution of laundry detergent is formed by dissolving a detergent tablet according to the invention in water, characterised in that the detergent tablet is placed in the dispensing drawer and water is passed through the dispensing drawer so that the tablet is dispensed as an aqueous solution of a laundry detergent, the aqueous solution subsequently being passed in the washing drum.

EXAMPLES

Example 1 i) A detergent base powder of composition C (see tables under) was prepared as follows: all the particulate material of base composition were mixed together in a mixing drum or spray drum to form a homogenous particulate mixture. During this mixing the spray-on of the binder system was carried out. After this stage, the matrix was separated in two different samples. The DIBS sticky hydrotope was added to only one of the samples and then processed independently in a Loedige KM 600®. The layer with DIBS was used for a harder bottom layer and the layer without DIBS was used for a softer top layer of a dual layer tablet.

ii) Using a Bonals® rotary press both matrices were filled in two independent force feeding flasks. The matrix with DIBS is consecutively filled first in the turret stations, followed by the second matrix (the without DIBS matrix). Both layers are compressed together in the pre-compression and compression stations to form a dual layer tablet with a harder bottom layer.

iii) In this particular example, the tablets have a rectangular cross section of 62.5 by 38.5 mm, a height of 20.5 mm and a weight of 48 gr. The height of the bottom layer corresponded to 25% of the total height of the tablet. If a round tablet is made of the bottom layer matrix with the same density as in the rectangular tablet (983 g/l), the tensile strength of the layer is 7.8 kPa. Using the same experiment (for a density of 991 g/l), the top layer of the tablet has an equivalent tensile strength of 5.1 kPa. Elasticity measurements gave values of 1.8 J/kN for the top layer and 3.3 J/kN for the bottom layer.

iv) In order to have a reference for the trials, tablets were made running the press with the same press settings but using the matrix without DIBS for both layers. This tablet has exactly the same density (991 g/l) and strength as the top layer of the dual layer tablets. The only difference between the dual layer tablet and the reference tablet is that the dual layer tablet has a bottom layer made with the matrix that has DIBS in its composition.

v) In order to prove the fact that a stronger bottom layer improves the resistance in the line, reference and dual layer tablets were conducted trough a series of roller belts of the line and then analysed separately for breakage grades. More than one hundred tablets of each series were made and analysed for the tests.

vi) In order to prove that the dispensing properties are not affected by the harder bottom layer, 10 tablets of each kind were tested with the standard dispensing tests described before.

vii) A difference was found between the dual layer tablets and the reference tablets. Most of the reference tablets were severely damaged in the bottom (the part of the tablets in contact with the roller belts and the belts in general) while the dual layer tablets with a harder bottom layer were almost not damaged. A clear difference in the amount of split tablets was also significantly reduced. The dispensing properties of the dual layer tablet were not affected by the harder bottom layer. The following table summarises the results of the conducted tests.

| Tablet type | % of tablets with damaged bottom | % of broken tablets | % of Dispensing residues |
|---|---|---|---|
| Reference | 98% | 18% | 1.8% |
| Dual layer | 10% | 5% | 2.5% |

Presented below are Examples for base particulate material composition for making laundry detergent tablets according to the invention, whereby a harder layer may be more compressed than a softer layer, or whereby diifferent compositions may be used or adapted for each layer.

| | Composition A (% per weight) |
|---|---|
| Anionic Agglomerates 1 | 21.45 |
| Anionic Agglomerates 2 | 13.00 |
| Cationic Agglomerate | 5.45 |
| Layered Silicate | 10.8 |
| Sodium percarbonate | 14.19 |
| Bleach activator agglomerates | 5.49 |
| Sodium carbonate | 13.82 |
| EDDS/Sulphate particle | 0.47 |
| Tetrasodium salt of Hydroxyethane Diphosphonic acid | 0.73 |
| Soil Release Polymer | 0.33 |
| Fluorescer | 0.18 |
| Zinc Phthalocyanide sulphonate encapsulate | 0.025 |
| Soap powder | 1.40 |
| Suds Suppressor | 1.87 |
| Citric acid | 7.10 |
| Protease | 0.79 |
| Lipase | 0.28 |
| Cellulase | 0.22 |
| Amylase | 1.08 |
| Binder Spray-on-system | 1.325 |
| TOTAL | 100.00 |

Anionic agglomerates 1 comprise of 40% anionic surfactant, 27% zeolite and 33% carbonate.

Anionic agglomerates 2 comprise of 40% anionic surfactant, 28% zeolite and 32% carbonate.

Cationic agglomerates comprise of 20% cationic surfactant, 56% zeolite and 24% sulphate.

Layered silicate comprises of 95% SKS 6 and 5% silicate.

Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Zinc phthalocyanine sulphonate encapsulates are 10% active.

Suds suppressor comprises of 11.5% silicone oil (ex Dow Corning); 59% of zeolite and 29.5% of water.

Binder spray-on system comprises of 50% Lutensit K-HD 96 and 50% PEG (polyethylene glycol).

| | Composition B (% per weight) |
|---|---|
| Anionic Agglomerates 1 | 21.45 |
| Anionic Agglomerates 2 | 13.00 |
| Cationic Agglomerate | 5.45 |
| Layered Silicate | 10.8 |
| Sodium percarbonate | 14.19 |
| Bleach activator agglomerates | 5.49 |
| Sodium carbonate | 12.645 |
| EDDS/Sulphate particle | 0.47 |
| Tetrasodium salt of Hydroxyethane Diphosphonic acid | 0.73 |
| Soil Release Polymer | 0.33 |
| Fluorescer | 0.18 |
| Zinc Phthalocyanide sulphonate encapsulate | 0.025 |
| Soap powder | 1.40 |
| Suds Suppressor | 1.87 |
| Citric acid | 7.10 |
| Protease | 0.79 |
| Lipase | 0.28 |
| Cellulase | 0.22 |
| Amylase | 1.08 |
| Binder Spray-on-system | 2.5 |
| TOTAL | 100.00 |

Anionic agglomerates 1 comprise of 40% anionic surfactant, 27% zeolite and 33% carbonate.

Anionic agglomerates 2 comprise of 40% anionic surfactant, 28% zeolite and 32% carbonate.

Cationic agglomerates comprise of 20% cationic surfactant, 56% zeolite and 24% sulphate.

Layered silicate comprises of 95% SKS 6 and 5% silicate.

Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Zinc phthalocyanine sulphonate encapsulates are 10% active.

Suds suppressor comprises of 11.5% silicone oil (ex Dow Corning); 59% of zeolite and 29.5% of water.

Binder spray-on system comprises of 50% Lutensit K-HD 96 and 50% PEG (polyethylene glycol).

| | Composition C (%) |
|---|---|
| Anionic agglomerates 1 | 9.1 |
| Anionic agglomerates 2 | 22.5 |
| Nonionic agglomerates | 9.1 |
| Cationic agglomerates | 4.6 |
| Layered silicate | 9.7 |
| Sodium percarbonate | 12.2 |
| Bleach activator agglomerates | 6.1 |
| Sodium carbonate | 7.27 |
| EDDS/Sulphate particle | 0.5 |
| Tetrasodium salt of Hydroxyethane Diphosphonic acid | 0.6 |
| Soil Release Polymer | 0.3 |
| Fluorescer | 0.2 |
| Zinc Phthalocyanine sulphonate encapsulate | 0.03 |
| Soap powder | 1.2 |
| Suds suppressor | 2.8 |
| Citric acid | 5.5 |
| Protease | 1 |
| Lipase | 0.35 |
| Cellulase | 0.2 |
| Amylase | 1.1 |
| Binder spray-on system | 3.05 |

-continued

| | Composition C (%) |
|---|---|
| Perfume spray-on | 0.5 |
| DIBS | 2.1 |

Anionic agglomerates 1 comprise of 40% anionic surfactant, 27% zeolite and 33% carbonate Anionic agglomerates 2 comprise of 40% anionic surfactant, 28% zeolite and 32% carbonate Nonionic agglomerate comprise 26% nonionic surfactant, 6% Lutensit K-HD 96, 40% Sodium acetate anhydrous, 20% carbonate and 8% zeolite.

Cationic agglomerates comprise of 20% cationic surfactant, 56% zeolite and 24% sulphate Layered silicate comprises of 95% SKS 6 and 5% silicate Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Zinc phthalocyanine sulphonate encapsulates are 10% active.

Suds suppressor comprises of 11.5% silicone oil (ex Dow Corning); 59% of zeolite and 29.5% of water.

Binder spray-on system comprises of 0.5 parts of Lutensit K-HD 96 and 2.5 parts of PEGs

| | Composition D (%) |
|---|---|
| Anionic agglomerates 1 | 32 |
| Cationic agglomerates | 5 |
| Layered silicate | 11.5 |
| Sodium percarbonate | 16.2 |
| Bleach activator agglomerates | 4.7 |
| Sodium carbonate | 3.76 |
| Sodium bicarbonate | 2.0 |
| Sodium sulphate | 2.4 |
| EDDS/Sulphate particle | 0.5 |
| Tetrasodium salt of Hydroxyethane Diphosphonic acid | 0.8 |
| Soil Release Polymer | 0.3 |
| Fluorescer | 0.1 |
| Zinc Phthalocyanine sulphonate encapsulate | 0.02 |
| Suds suppressor | 2.1 |
| Citric acid | 2 |
| Protease | 0.7 |
| Lipase | 0.2 |
| Cellulase | 0.2 |
| Amylase | 0.6 |
| Perfume encapsulates | 0.2 |
| Polymer particle | 3 |
| Perfume spray-on | 0.35 |
| Nonionic spray-on system | 5.17 |
| Zeolite | 6.2 |

Anionic agglomerates 1 comprise of 40% anionic surfactant, 27% zeolite and 33% carbonate Cationic agglomerates comprise of 20% cationic surfactant, 56% zeolite and 24% sulphate Layered silicate comprises of 95% SKS 6 and 5% silicate Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Zinc phthalocyanine sulphonate encapsulates are 10% active.

Suds suppressor comprises of 11.5% silicone oil (ex Dow Corning);. 59% of zeolite and 29.5% of water.

Perfume encapsulates comprise 50% perfume and 50% starch.

Polymer particle comprises 36%, 54% zeolite and 10% water

The Nonionic spray-on system comprises of 67% C12–C15 AE5 (alcohol with an average of 5 ethoxy groups per molecule), 24% N-methyl glucose amide and 9% water.

What is claimed is:

1. A detergent tablet having at least a first and a second layer, whereby the first layer is softer than the second layer, and if said tablet has more than two layers, the tablet is such that a softer layer is situated at an end of the tablet whereby the tablet comprises sodium di isoalkylbenzene sulphonate.

2. A tablet according to claim 1, whereby the softer layer comprises higher levels per weight of surfactants.

3. A tablet according to claim 1, whereby the tablet is such that the softest layer is situated at an end of the tablet.

4. A tablet according to claim 1, whereby the tablet is such that the less soft layer is situated at an end of the tablet.

5. A tablet according to claim 1, whereby the whole tablet contains at least 5% per weight of surfactant.

6. A tablet according to claim 1, the whole tablet having a density of less than 2 g/cc.

7. A tablet according to claim 1, whereby the tablet has a substantially square or rectangular cross section.

8. A tablet according to claim 1 wherein the tablet further comprises a bleach activator.

9. A tablet according to claim 1 wherein the tablet is a coated tablet.

10. A method for making a tablet according to claim 1 whereby the less soft layer of the tablet is placed on the bottom end of the tablet during production.

11. A detergent tablet having at least a first and a second layer, whereby the first layer is softer than the second layer, and if said tablet has more than two layers, the tablet is such that a softer layer is situated at an end of the tablet, wherein the softer layer comprises higher levels per weight of surfactants and wherein the tablet comprises sodium di isoalkylbenzene sulphonate.

12. A tablet according to claim 11, whereby the tablet is such that the softest layer is situated at an end of the tablet.

13. A tablet according to claim 11, whereby the tablet is such that the less soft layer is situated at an end of the tablet.

14. A tablet according to claim 11, whereby the whole tablet contains at least 5% per weight of surfactant.

15. A tablet according to claim 11, the whole tablet having a density of less than 2 g/cc.

16. A tablet according to claim 15, whereby the tablet has a substantially square or rectangular cross section.

17. A tablet according to claim 11 wherein the tablet is a coated tablet.

18. A tablet according to claim 11 wherein the tablet further comprises a bleach activator.

19. A tablet according to claim 14, the whole tablet having a density of at least 0.9 g/cc.

20. A method for making a tablet according to claim 11, whereby the less soft layer of the tablet is placed on the bottom end of the tablet during production.

* * * * *